US005375638A

United States Patent [19]

Green et al.

[11] Patent Number: 5,375,638

[45] Date of Patent: Dec. 27, 1994

[54] LOG SPLITTER

[75] Inventors: Robert H. Green, Bowling Green, Ohio; Dennis D. Price, Joliet, Ill.

[73] Assignee: Clarke Power Products, Inc., Bowling Green, Ohio

[21] Appl. No.: 135,687

[22] Filed: Oct. 13, 1993

[51] Int. Cl.[5] ..... B27L 7/00

[52] U.S. Cl. ..... 144/193 A; 91/181; 92/63; 144/193 E; 144/366

[58] Field of Search ..... 91/167 R, 181, 410, 91/424; 92/61, 63, 111, 130 R; 144/193 R, 193 A, 366, 193 E

[56] References Cited

U.S. PATENT DOCUMENTS

| | | | |
|---|---|---|---|
| 2,577,462 | 12/1951 | Hackney | 144/193 A |
| 3,077,214 | 2/1963 | Brukner | 144/193 A |
| 3,242,955 | 3/1966 | Hellstrom | 144/193 A |
| 3,779,295 | 12/1973 | Balsbaugh | 144/193 A |
| 4,240,476 | 12/1980 | Rattray . | |
| 4,275,778 | 6/1981 | Kotas | 144/193 E |
| 4,293,013 | 10/1981 | Phelps et al. | 144/193 A |
| 4,310,039 | 1/1982 | O'Brien . | |
| 4,351,377 | 9/1982 | Hamel . | |
| 4,351,378 | 9/1982 | Smith . | |
| 4,366,847 | 1/1983 | Blecha . | |
| 4,367,763 | 1/1983 | Brand | 144/193 A |
| 4,374,532 | 2/1983 | Region . | |
| 4,380,258 | 4/1983 | Hanser . | |
| 4,428,409 | 1/1984 | Roetzler | 144/193 E |
| 4,441,535 | 4/1984 | Flinn et al. . | |
| 4,444,232 | 4/1984 | Loos | 144/193 E |
| 4,454,902 | 6/1984 | Larger . | |
| 4,481,988 | 11/1984 | Watson et al. . | |
| 4,544,008 | 10/1985 | Reini . | |
| 4,596,279 | 6/1986 | Taylor . | |
| 4,615,366 | 10/1986 | Scarbrough, Jr. . | |
| 4,621,668 | 11/1986 | York . | |
| 4,653,558 | 3/1987 | Porter | 144/366 |
| 4,782,870 | 11/1988 | Duerr . | |

*Primary Examiner*—W. Donald Bray
*Attorney, Agent, or Firm*—MacMillan, Sobanski & Todd

[57] ABSTRACT

An improved hydraulic log splitter which includes a hydraulic reservoir formed integrally with a frame of the log splitter. Hydraulic fluid from the reservoir is supplied by a pump to a control valve. A fluid passage is open through the control valve to a hydraulic intensifier which includes a cylinder and a piston extendable from the cylinder. The piston pushes a log against a stationary splitting wedge. The piston is urged toward a retracted position by a return spring internal to the cylinder. When the control valve is in other than an "extend" position, hydraulic fluid supplied to the control valve is allowed to flow into a return conduit back to the reservoir. In this condition, the pressure the hydraulic fluid develops insufficient force to overcome the force exerted by the return spring, and the ram remains retracted. When the control valve is placed in the "extend" position, fluid that flows to the return conduit is blocked and the pressure in the hydraulic intensifier rises to overcome the force of the spring and advance the ram. A log placed on the splitter is thus driven by the piston to be split by the wedge. The wedge is designed to force the log against guide rails during splitting.

10 Claims, 5 Drawing Sheets

LOG SPLITTER

TECHNICAL FIELD

The invention relates in general to new and useful improvements for harvesting firewood and in particular to an improved structure for a log splitter.

BACKGROUND OF THE INVENTION

Hydraulically actuated log splitters are known, and are normally provided with a ram extended under a hydraulically generated force to drive a log into a splitting wedge. After the log is split, the ram is retracted utilizing hydraulic force acting in the opposite direction. Typically, if the ram should be obstructed during retraction, hydraulic pressure builds up, and the force exerted to retract the ram increases. This presents a safety concern if a portion of the operator's body were to be accidentally engaged by the ram during retraction.

For the safety of the operator, it is known to utilize a device which senses the pressure developed during ram retraction. The device diverts hydraulic fluid from the ram if a pressure buildup is sensed during retraction, for example by repositioning the control valve to a neutral position. Such a device is not passively safe; it requires a positive action of the device to perform the safety function.

SUMMARY OF THE INVENTION

The invention relates to an improved structure for a log splitter which includes passive safety features. The log splitter includes a frame upon which is mounted a splitting wedge and a hydraulic system including a hydraulic intensifier provided with a ram, a motor driven hydraulic pump, a reservoir, and a control valve. In a preferred embodiment the reservoir is formed integrally with the frame. The pump supplies hydraulic fluid from the reservoir through a supply conduit to the control valve which controls the delivery of fluid to the hydraulic intensifier. The ram is urged toward a retracted position by a spring internal to the hydraulic intensifier. If the control valve is in other than an "extend" position, the hydraulic fluid is directed into a return conduit back to the reservoir. The force developed by the fluid pressure in the hydraulic intensifier is insufficient to overcome the force exerted by the spring, and the ram remains retracted. If the control valve is placed in the "extend" position, the path to the return conduit is blocked off, and hydraulic pressure builds up in the hydraulic intensifier. The force developed by the fluid pressure overcomes the spring pressure, and the ram extends towards the wedge. A log placed between the ram and the wedge will be split by the wedge. After the log is split, the control valve is taken out of the extend position, and the path to the return line is opened. Hydraulic pressure decreases, and the force the fluid exerts decreases to less than the force developed by the spring, causing the ram to retract. The log splitter includes an improved wedge having a lower end secured to the frame and a free upper end. The diverging faces of the wedge form a greater angle at the free end than at the secured lower end. This causes a log to be split more rapidly by the free end of the wedge, thereby forcing the log downwardly against the frame.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
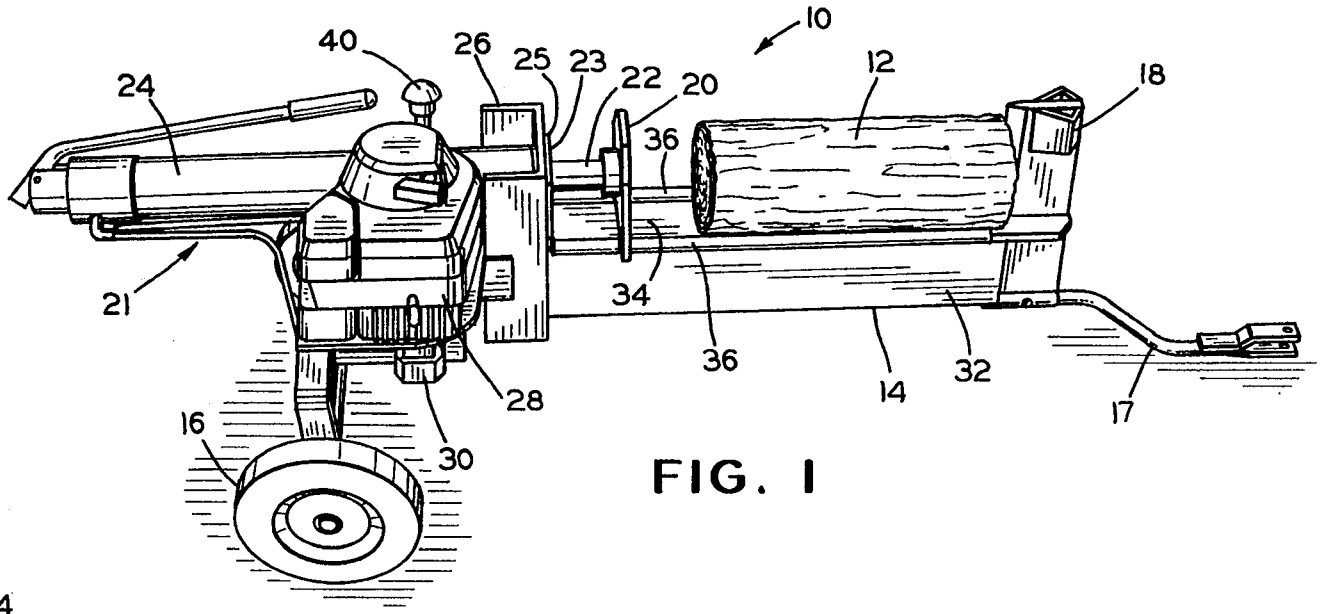
FIG. 1 is a perspective view of a log splitter constructed in accordance with the invention.
Figure 2:
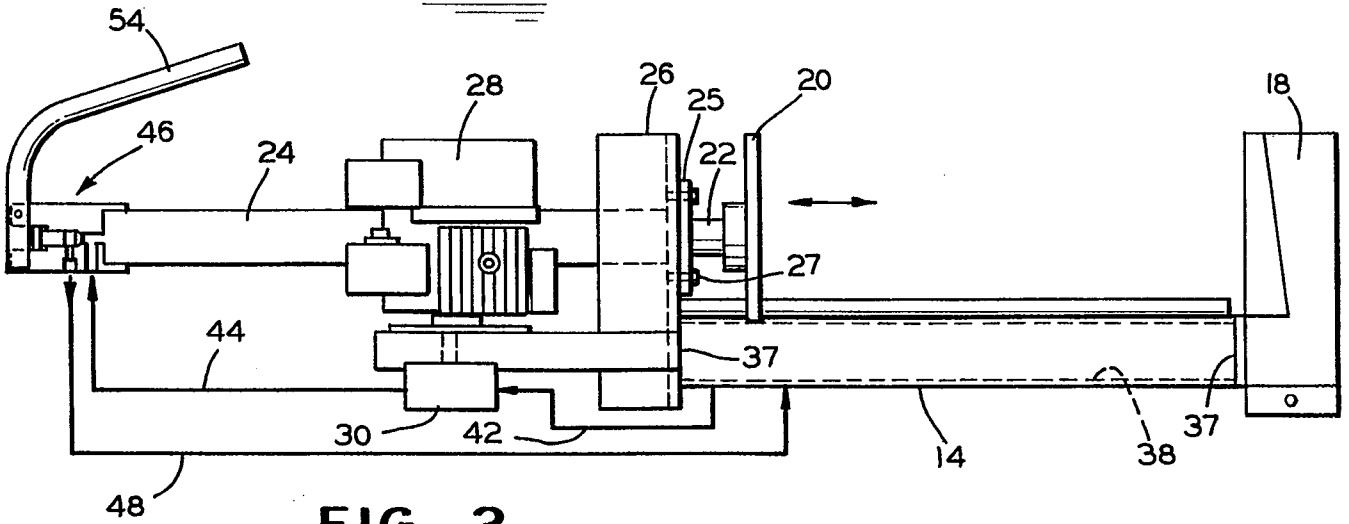
FIG. 2 is a side schematic diagram of the log splitter shown in FIG. 1.

Referring now to the drawings, there is illustrated in FIGS. 1 and 2 a log splitter, indicated generally at 10. The log splitter 10 is shown with a log 12 in position to be split. The log splitter 10 has a frame 14 supported by wheels 16, and a tongue 17 adapted to receive a conventional hitch (not shown) for connecting the log splitter 10 to a towing vehicle. A log splitting wedge 18 is secured to the frame 14 and opposes a moveable log splitting member or ram 20. The ram 20 is adapted for linear movement relative to the wedge 18, and is driven by a hydraulic intensifier 21. The hydraulic intensifier 21 includes a piston 22 secured to the ram 20 and extendable from an end 23 of a cylinder 24. The end 23 is welded to an end flange 25.

A support member 26 extends vertically from the frame 14. The support member 26 preferably is a length of channel iron having a generally C-shaped cross section, with a middle section oriented perpendicular to the axis of the log splitter 10. The cylinder 24 extends through an opening (not shown) in the support member 26 and the flange 25 on the cylinder 24 is secured by bolts 27 (FIG. 2) to the support member 26. The flange 25 is secured to the side of the support member 26 facing the wedge 18. It will be appreciated that this arrangement permits large reaction forces generated on the cylinder 24 during log splitting operations to be transmitted directly from the flange 25 to the support member 26, and not through the threaded fasteners 27.

The frame 14 supports an engine 28. The engine 28 in a preferred embodiment is a vertical shaft gasoline internal combustion engine. However, other types of prime movers, such an electric motor, may be utilized and are intended to be broadly encompassed by the term "engine". The engine 28 drives a hydraulic pump 30. The pump 30 depends from the frame 14 be low the engine 28. This permits the pump 30 to occupy a low position relative to the rest of the hydraulic system, thereby permitting the pump 30 to prime more easily. A vertical engine shaft facilitates placement of the pump 30 in a low position. Additionally, in the gasoline engines of the preferred embodiment, vertical shaft engines are typically less expensive and have a lower center of gravity which improves the overall stability of the log splitter 10.

The portion of the frame 14 between the ram support member 26 and the wedge 18 is formed of rectangular cross section tubing 32 which advantageously has a flat upper surface 34 to support the log 12. Side rails 36 may be welded or otherwise secured to the tubing 32 to aid in retaining the log 12 on the flat surface 34 during splitting. Additionally, the ram 20 is preferably provided with notches (not shown) in the lower periphery thereof which loosely conform to the upper outer surfaces of the rails 36. The rails 36 thereby aid in guiding and supporting the ram 20 during movement of the ram 20.

The tubing 32 is closed at opposite axial ends by bulkheads 37 to define a reservoir 38 (FIG. 2) formed integrally with the frame 14. The bulkheads 37 provide lateral support to the walls of the tubing 32 and form part of the frame 14. The use of the tubular frame 14 to form the bottom, side and top walls of the reservoir 38 reduces the weight of the log splitter 10 by eliminating the need to provide a separate hydraulic fluid reservoir tank. The reservoir 38 receives a supply of hydraulic fluid through a filling tube 40.

As seen in FIG. 2, hydraulic fluid from the reservoir 38 is supplied to the pump 30 via a suction conduit or line 42. The pump 30 discharges pressurized fluid through a supply conduit or line 44 to a control valve 46. The control valve 46 directs the fluid either back to the reservoir 38 via a return conduit or line 48 or to the cylinder 24. The conduits 42, 44 arid 48 are preferably rigid metallic tubing.

Figure 3:
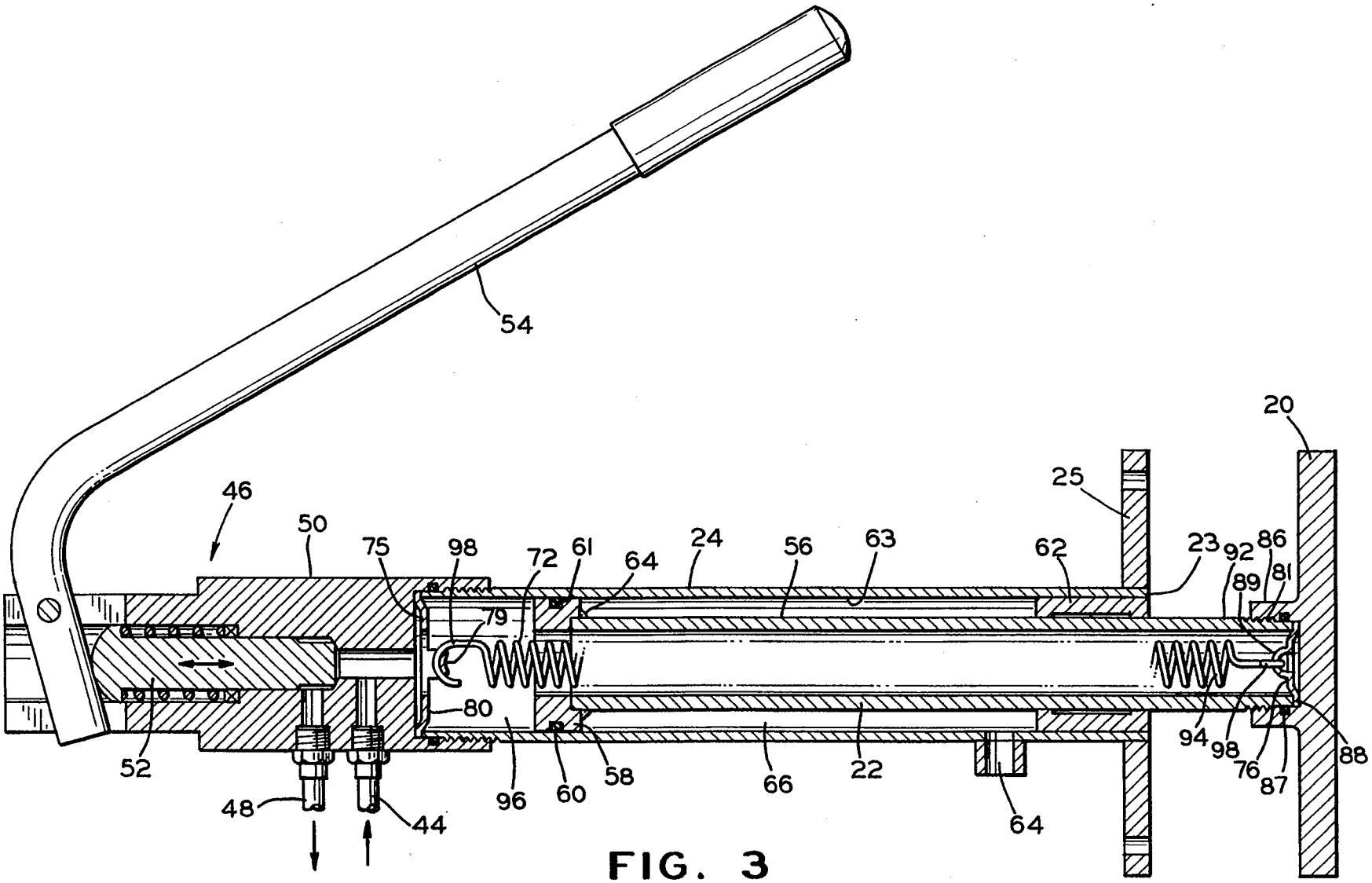
FIG. 3 is a cross sectional side elevational view of the hydraulic control valve, cylinder and ram of the present invention.

Referring now to FIG. 3, the control valve 46 is threaded onto an end 47 of the cylinder 24 opposite from the end 23. The control valve 46 is supported by the cylinder 24. The control valve 46 includes a body 50 and a valve piston 52 which is manually operated by a handle 54. As will be further discussed below, the control valve 46 may be operated in an extend mode to direct the flow of fluid from the supply conduit 44 into the cylinder 24, or in a neutral mode in which the :fluid flows into the return conduit 48.

As indicated previously, the piston 22 is extendable from the end 23 of the cylinder 24. The piston 22 includes a cylindrical piston tube 56 secured to a collar 58. The collar 58 is in sliding engagement with the interior surface of the tubular cylinder 24. An O-ring seal 60 is positioned in an annular groove 61 on the collar 58 to provide a fluid-tight sliding seal between the collar 58 and an interior surface 63 of the cylinder 24.

The collar 58 positions and supports an interior end 64 of the piston tube 56. A bushing 62 is positioned about the piston tube 56 within the end 23 of the cylinder 24. The bushing 62 provides additional positioning and a sliding support for the piston tube 56. The bushing 62 also keeps contaminants, such as wood chips, off of the interior surfaces of the cylinder 24, where they might damage the seal 60 or jam the piston 22.

A drain opening 64 drains any hydraulic fluid which may leak into an annular space 66 between the collar 58 and the bushing 62. Hydraulic fluid might enter the space 66 if the seal 60 were damaged. There is a possibility that the piston 22 may draw contaminants past the bushing 62 and into the space 66, contaminating any fluid in the space 66. Therefore, the drain 64 directs fluid for disposal outside of the log splitter 10, rather than back to the reservoir 38, for example. The drain 64 additionally acts to vent the space 66, preventing hydraulic lock as the collar 58 moves relative to the bushing 62, changing the volume of the space 66.

Figure 4:
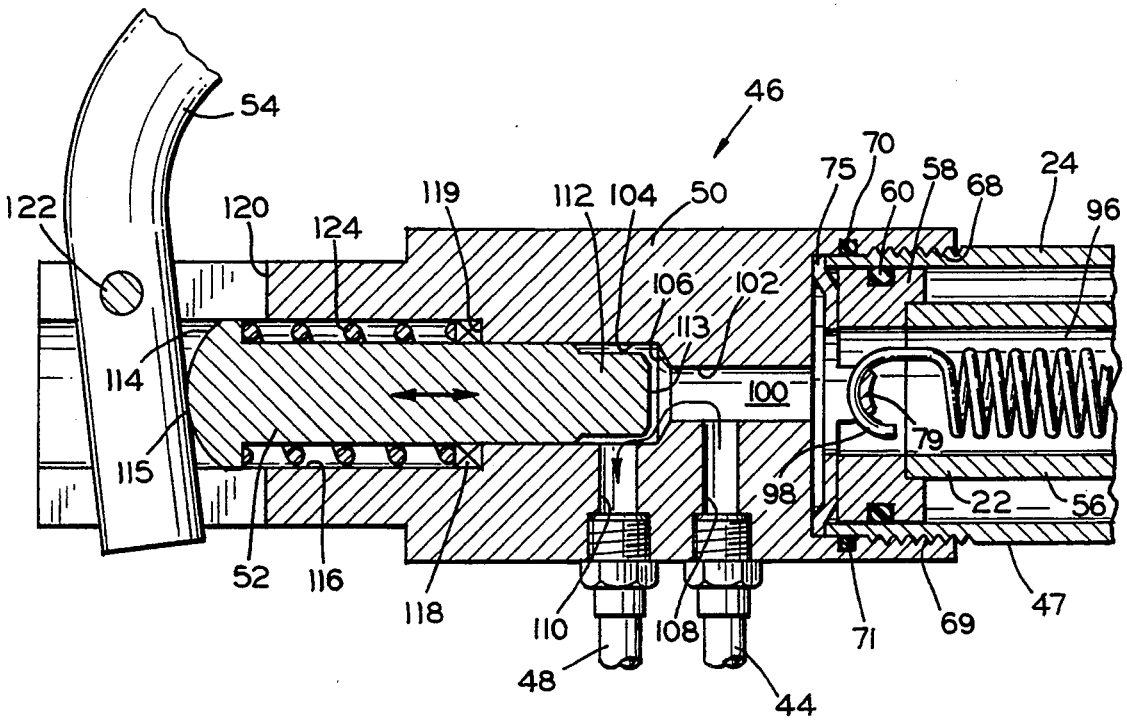
FIG. 4 is an enlarged fragmentary cross sectional view of the control valve of FIG. 3 in which the valve is in a neutral position.
Figure 5:
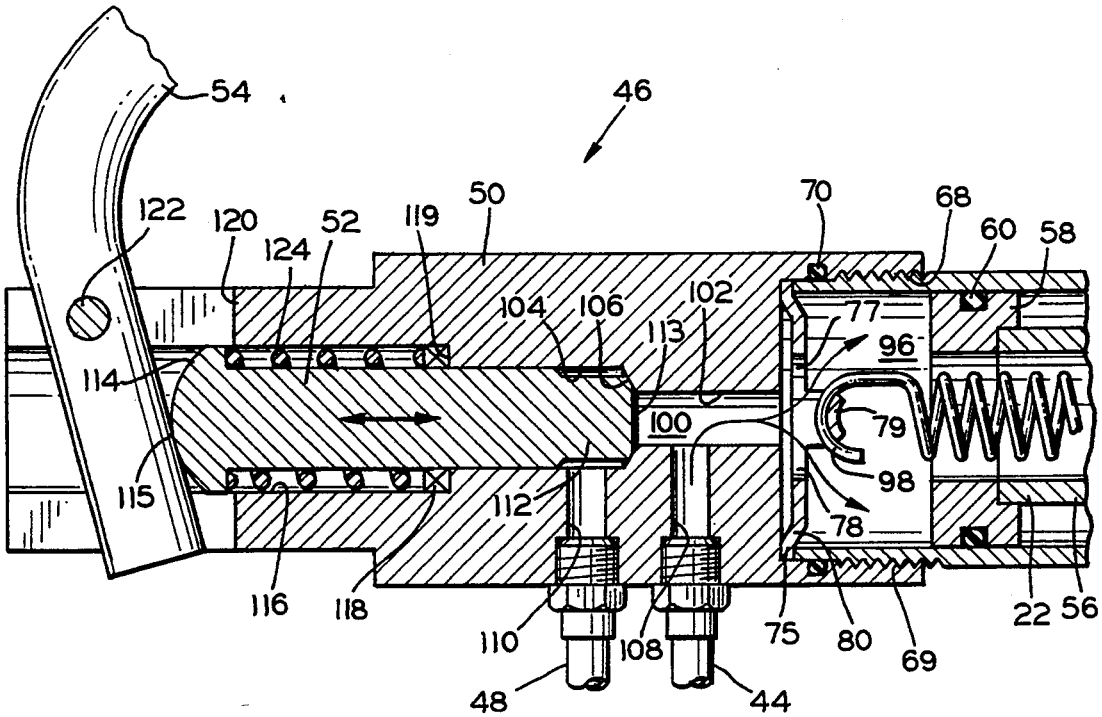
FIG. 5 is a view similar to that of FIG. 4, showing the valve in an extend position.

As best seen by referring to FIGS. 4 and 5, a threaded recess 68 is formed in the valve body 50. The threaded recess 68 receives and retains an exterior threaded portion 69 on the cylinder end 47. An O-ring seal 70 is seated in an annular recess 71 formed in the wall of the recess 68 to form a fluid-tight seal between the valve body 50 and the cylinder 24.

Figure 11:
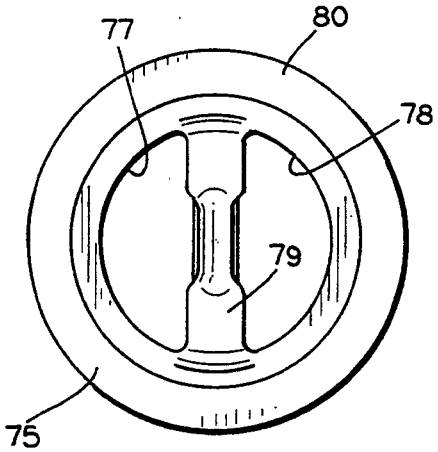
FIG. 11 is a plan view of the spring retainer.

The log splitter 10 is provided with an internal spring 72 for urging the piston 22 toward a retracted position wherein the ram 20 is adjacent the flange 25. In the preferred embodiment, the internal spring 72 is a helical tension spring extending between a first spring retainer 75 and a second spring retainer 76. As seen in FIG. 11, the first spring retainer 75 is generally disk-shaped, and may be formed of metal by any suitable means such as stamping or casting. Two spaced-apart semicircular openings 77 and 78 are formed in the retainer 75, and are in part defined by a tab 79 extending therebetween. The tab 79 is fixed at each end to an annular flange 80. Referring again to FIGS. 4 and 5, it will be appreciated that the tab 79 is bowed out of the plane of the flange 80, and has generally arcuate cross section which aids in resisting deformation under the tension of the spring 72.

The flange 80 on the spring retainer 75 is captured between the control valve body 50 and the end 47 of the cylinder 24. The flange 80 may be embossed or dished slightly to aid in keeping the spring retainer 75 centered on the end of the cylinder 24 during assembly. The spring retainer 75 is oriented such that the bowed tab 79 extends partially into the cylinder 24. The openings 77 and 78 permit fluid communication between the control valve 46 and the interior of the cylinder 24.

As seen in FIG. 3, the second spring retainer 76 is similar in design to the first spring retainer 75. Also, the arrangement for securing the spring retainer 76 is generally the same as for securing the spring retainer 75. The ram 20 has an internally threaded coupling 86 which engages a threaded piston end 81. An O-ring seal 87 is seated in an annular groove 88 formed in the coupling 86 to provide a fluid-tight seal between the piston tube 56 and the coupling 86. A flange 88 on the spring retainer 76 is captured between the piston end 81 and the ram 20. A bowed tab 89 extends diametrically across the spring retainer 76. Unlike the flange 80, the flange 88 need not be dished since fluid does not flow through the retainer 76. Since the spring retainers 75 and 76 each have a circular perimeter and are retained within cylindrical components, they may be rotated as desired to best engage the spring 72.

The piston 22 and the cylinder 24 cooperate to define an expansion chamber 96 extending between the spring retainer 75 and the spring retainer 76. The spring 72 is located within the chamber 96 for urging the piston 22 toward a retracted position abutting the spring retainer 75. The spring 72 includes hooked ends 98 or other means for engaging the tab 79 of the spring retainer 75 and the tab 89 of the spring retainer 76.

Referring now to FIGS. 4 and 5, the control valve body 50 defines a central bore 100 having a first portion 102, and a second portion 104, which is of greater diameter than the first portion 102. The first portion 102 and the second portion 104 are joined at a frustro-conical surface 106. The first portion 102 is in fluid communication with the chamber 96 via the openings 77 and 78 through the spring retainer 75. The first portion 102 is also in fluid communication with the supply conduit 44 via a fluid inlet 108. The second portion 104 is in fluid communication with the return conduit 48 via a fluid outlet 110.

The valve piston 52 slides in the second bore portion 104. The valve piston 52 has a reduced diameter portion 112 adjacent an end 113 and an enlarged diameter head 114 adjacent an end 115. The reduced diameter portion 112 is greater in diameter than the first central bore portion 102. When the control valve is placed in the neutral mode as shown in FIG. 4, the piston end 113 is retracted from the frusto-conical surface 106. When the control valve 46 is placed in the extend mode as shown in FIG. 5, the valve piston 52 is advanced, causing the reduced diameter portion 112 of piston end 113 to seat against the frusto-conical surface 106, providing a fluid-tight seal. The valve piston 52 thus provides means for selectively permitting and preventing fluid communication between the fluid inlet 108 and the fluid outlet 110.

The central bore 100 also includes a third portion 116 which has a greater diameter than the second portion 104. A fluid seal 118 is seated against a step 119 defined between the second bore portion 104 and the third bore portion 116. The seal 118 provides a fluid tight seal between the axially sliding valve piston 52 and the valve body 50.

A vertical slot 120 is formed through the free end of the valve body 50. The valve handle 54 is received in the slot 120 and is pivotally retained by a pin 122 traversing the upper portion of the slot 120. The pin 122 preferably includes a threaded portion (not shown) securing the pin 122 to the valve body 50.

A spring 124, acting between the seal 118 and the piston head 114, urges the piston end 113 away from the frustro-conical surface 106, as shown in FIG. 4. When the piston 52 is in this position, fluid flows from the supply line 44 to the return line 48. The valve handle 54 may be lifted, causing it to rotate counter-clockwise on the pin 122 in FIGS. 1 through 5. The valve handle 54 thereby bears against the valve piston 52, overcoming the force of the spring 124 and urging the piston end 113 against the frustro-conical surface 106, as illustrated in FIG. 5. When the piston 52 is in this position, fluid flows from the supply line 44 into the expansion chamber 96.

Figure 7:
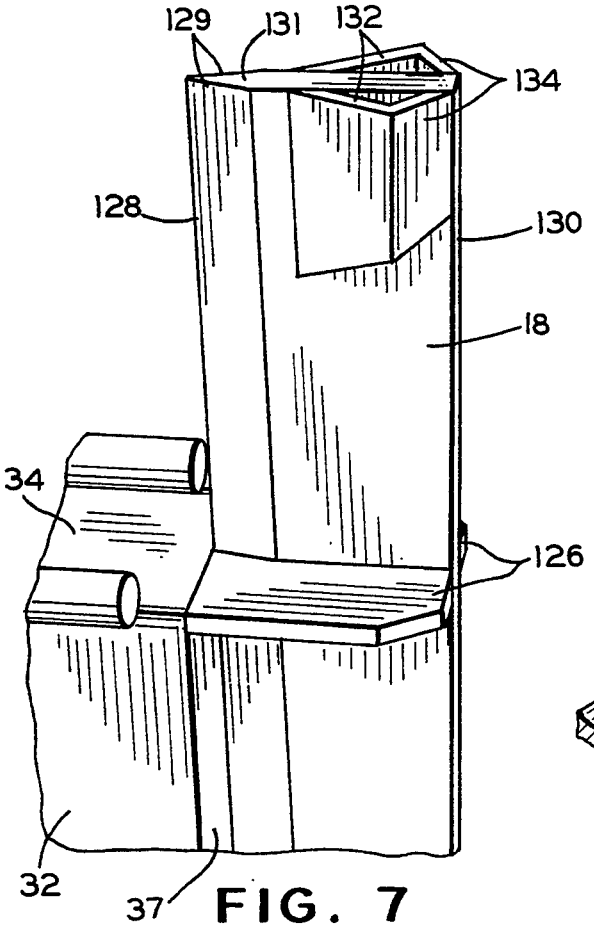
FIG. 7 is an enlarged perspective view of the wedge shown in FIG. 1.

As most clearly illustrated in FIG. 7, the wedge 18 is a plate extending vertically between two horizontal flanges 126. The flanges 126 are welded or otherwise secured to the bulkhead 37 proximate the upper surface 34 of the tubing 32. A fixed end 127 of the wedge 18 is attached, preferably by welding, both to the flanges 126 and to the bulkhead 37. The wedge 18 extends above the plane of the upper surface 34 of the tubing 32 and includes a splitting edge 128 formed by two intersecting surfaces 129 generally perpendicular to the plane of the upper surface 34. The splitting edge 128 faces the ram 20.

The wedge 18 includes means for applying a downward force on a log 12 being split, urging the log 12 away from a free end 131 of the wedge 18. This means may include an auxiliary wedge 130 formed adjacent the free wedge end 131. In the preferred embodiment, the auxiliary wedge 130 is formed from opposed metal plates 132 having a V-shaped cross-section and welded at either end to opposing sides of the upper portion of the wedge 18. Alternatively, however, the auxiliary wedge 130 may be formed otherwise, such as forged integrally with the wedge 18. The auxiliary wedge 130 thus forms diverging portions 132 extending outwardly from the sides of the upper portion of the wedge 18 and supported by converging portions 134 of the V-shaped plates 132.

The auxiliary wedge 130 does not extend vertically along the entire height of the upper portion of the wedge 18, being confined to the upper half of the wedge 18, and preferably to approximately the upper third thereof. The wedge 18 is thicker through the auxiliary wedge 130 than through a point below the auxiliary wedge 130. As will be further explained below, this unequal thickness of the wedge 18 creates a downward force on the log 12 during splitting and assists in retaining the log 12 in position on the log splitter 10.

Figure 8:
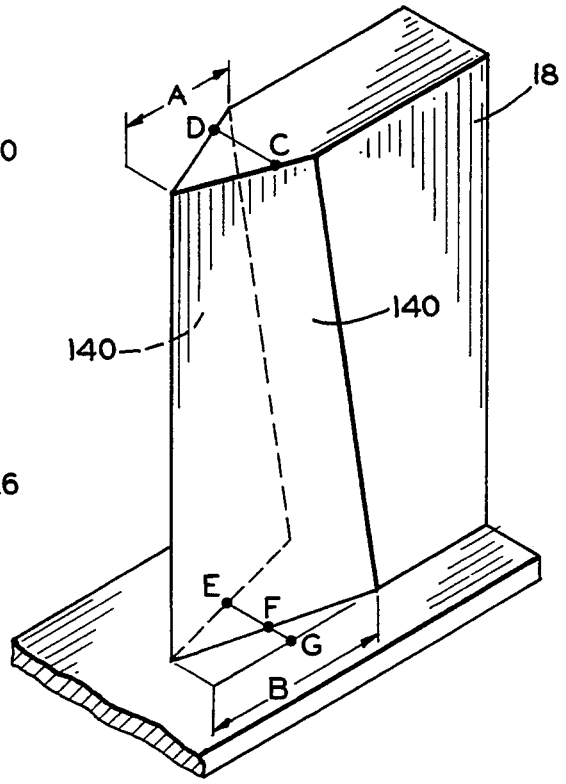
FIG. 8 is a perspective view of an alternate embodiment of the wedge shown in FIGS. 1 and 7.

An alternate embodiment of a wedge 18' is shown in FIG. 8. The wedge 18' includes divergent faces 140 defining a splitting edge 128'. The splitting edge 128' defines a line generally perpendicular to the plane of the upper surface 34 of the tubing 32 and faces the ram 20, as did the splitting edge 128 described above. The faces 140 define a first angle A at a fixed end 127' of the wedge 18'. The faces define a second angle B at a free end 131' of the wedge 18'. The first angle A is smaller than the second angle B. Thus, the faces 140 diverge away from the splitting edge 128' more rapidly near the free end of the wedge 18' than adjacent the lower portion thereof. As with the FIG. 7 embodiment, the unequal thickness of the wedge 18' between the faces 140 applies a downward force urging the log 12 away from the free end 131' of the wedge 18'. This force assists in retaining the log 12 in position on the log splitter 10.

In operation, the engine 28 is started to drive the pump 30. The pump 30 draws hydraulic fluid through the suction line 42 from the reservoir 38 and supplies the fluid to the control valve 46 via the supply conduit 44. With the control valve 46 in the retract position, the fluid is returned from the central bore 100 to the reservoir 38 via the outlet 110 and the return line 48, as seen in FIG. 4. The central bore 100 is in communication with the chamber 96. However, the fluid path through the outlet 110 bleeds off pressure from the central bore 100. The force exerted by the hydraulic fluid within the chamber 96 on the piston 22 is consequently insufficient to overcome the force exerted on the piston 22 by the piston return spring 72. The spring 72 thus maintains the piston 22 and the attached ram 20 in the retracted position.

A log 12 of a desired size and length is selected and positioned on the upper surface 34 of the tubing 34, extending longitudinally between the ram 20 and the wedge 18. The control valve 46 then is placed in the extend mode by pulling upwardly on the handle 58. The handle bears on the head 114 of the valve piston 52. The valve piston 52 is urged inwardly into the valve body 50 to engage the frustro-conical surface 106, thereby blocking flow of the hydraulic fluid to the outlet 110 and to the return line 48, as shown in FIG. 5.

As the pump 30 continues to deliver hydraulic fluid to the central bore 100, the pump discharge pressure, and thus the pressure in the expansion chamber 96, rapidly rises due to the incompressible nature of hydraulic fluid. The pressure in the chamber 96 exerts a force on the piston 22, which overcomes the spring 72 force, and causes the piston 22 to extend. The pressure in the chamber 96 continues to increase as the piston 22 extends because the spring 72 exerts a greater force as the spring 72 stretches.

As the piston 22 extends the side rails 36 provide support and guidance for the ram 20. The ram 20 engages the log 12 and forces it into the spitting edge 120 of the wedge 18, thus splitting the log 12. A portion of the wedge 18 has a thicker cross-section at the free end 131 than adjacent the support flanges 126 due to the presence of the auxiliary wedge 130 adjacent the free end. In the alternate embodiment of the wedge 18, the skew divergent faces 140 also cause a portion of the wedge 18 to have a thicker cross-section above a relatively thinner cross-section. The presence of an unequal vertical cross-section, that is, a relatively thick cross-section over a relatively thin cross-section, causes the log 12 to be split faster at the top than at the bottom. The unequal splitting by the wedge 18 produces a downward thrust on the log 12. Past log splitters used wedges of constant vertical cross-section, which occasionally allowed a log to ride up over the wedge when irregularities in the log were encountered. The downward force developed by the wedge 18 of the present invention helps retain the log 12 in position during splitting.

In the preferred embodiment, the pump 30 is a rotary pump. Rotary pumps deliver practically constant volumetric flows at a given speed, regardless of change in discharge pressure. This permits predictable and constant extension speeds for the piston 22. Due to the limited slip or internal bypass leakage characteristic of rotary pumps, they are capable of generating very high discharge pressures, thereby generating the tremendous forces needed to split the log 12. It is known to provide a relief valve to prevent dangerously high pressures from being generated by the pump of a hydraulic log splitter in the event of jamming or overloading of the hydraulic ram. Actuation of the relief valve in past log splitters directed flow from the discharge of the pump to the suction of the pump, and prevented the discharge pressure from exceeding the design pressure of the various components of the hydraulic system such as the pump, the ram, or fluid conduits. However, a relief valve adds to the cost and complexity of the hydraulic system of a log splitter. Further, the valve is required to change state (open) in order to provide this safety function.

Advantageously, the engine of the present invention is selected with performance characteristics which do not permit the pump 30 to develop a discharge pressure in excess of the design pressure oil the pump 30 and the other hydraulic system components. This is a passive design feature which eliminates the need for reliance on the active operation of relief valves to protect against system overpressure in selecting the engine 28 for a rotary pump, the following formula is illustrative:

$$P=T/(KD),$$

where P is the pressure rise through the pump;

T is the torque applied to the pump;

D is the displacement per revolution of the pump; and

K is a constant used to convert D to desired units ($K=0.01326$ when T is in foot-pounds, D is in cubic inches per revolution, and P is in pounds per square inch (p.s.i.)).

In the preferred embodiment, the pump 30 displaces (D) 0.129 cubic inches per revolution. An engine 28 may be selected which applies a maximum torque (T) of 4.6 foot-pounds to the pump 30 (see FIG. 6). Substituting these values into the equation above, the maximum pressure rise through the pump 30 is approximately 2690 p.s.i. The reservoir 38 is maintained at atmospheric pressure, or zero gauge pressure. Adding the pressure rise through the pump 30 indicates that the discharge gauge pressure of the pump 30 is approximately 2690 p.s.i. All of the components of the hydraulic system in the preferred embodiment which may be subjected to hydraulic fluid pressure are designed to withstand greater than 3000 p.s.i. gauge pressure.

Figure 6:
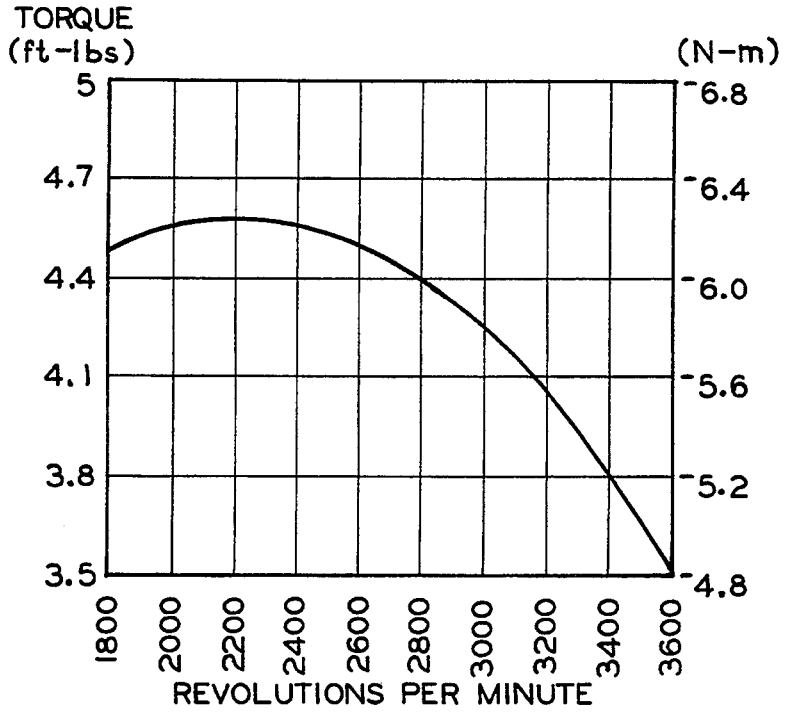
FIG. 6 is a torque curve for a typical engine to be utilized with the log splitter shown in FIG. 1.

At maximum torque output of the engine 28, the discharge pressure of the pump 30 is incapable of exceeding the design pressure of the hydraulic system components. As indicated in FIG. 6, in the preferred embodiment if one attempted to speed up the engine 28 to increase pump 30 output, torque would decrease. If the flow of fluid out of the pump 30 were restricted such that the pressure would continue to rise if the pump 30 continued to operate, the engine 28, unable to deliver any additional torque to rotate the pump 30, would cease to rotate. With the engine 28 stalled, the pump 30 would also cease rotation and cease pumping, thereby preventing any further increase in pressure. As indicated above, this is a passive safety feature. Unlike the positive action required by a safety valve, no component needs to actuate to prevent the pump 30 of the present invention from exceeding design pressures of the hydraulic system components.

During operation with the piston end 113 seated against the frustro-conical surface 106, fluid pressure in the first portion 102 of the bore 100 acts in a manner tending to unseat the piston 52. Thus the operator must maintain upward pressure on the handle 54 to keep the piston 52 seated. The axial face of the reduced diameter portion 112 of the piston 52 presents a relatively small surface area on which pressurized fluid in the bore 100 can act. Thus, only a limited force is exerted by the fluid upon the piston 52. The valve spring 124 also exerts a force on the valve piston 52 tending to unseat the piston 52. These combined forces tending to unseat the piston 52 are easily overcome by an operator of average strength, owing to the mechanical advantage afforded by the length of the handle 54.

In a typical hydraulic system, it is normal to place a valve disk or piston on the high pressure side of a valve seat, to the end that the hydraulic fluid pressure will act to help seat the valve. In the present invention, this "normal" configuration is deliberately reversed, as described above, with fluid pressure acting to unseat the piston 52. This feature ensures that the operator is positioned at the handle 54, away from the area in which the ram 20 is splitting the log 12 on the wedge 18.

When the operator releases the handle 54, whether because the log 12 has been completely split or for any other reason, the handle 54 will drop and rotate about the pin 122 under the combined action of gravity and the thrust of the piston 52 against the handle 54. The piston 52 develops a thrust against the handle 54 under the combined action of the fluid pressure and the valve spring 124 acting to unseat the piston 52 as described above. As the handle 54 rotates about the pin 122 the piston 52 unseats from the frustro-conical surface 106, opening a passage from the first portion 102 to the second portion 104 of the central bore, as seen in FIG. 4. From the second portion 104, the fluid may flow back to the reservoir 38 via the return line 48. Thus, releasing the handle 54 takes the control valve 46 out of the extend mode and into the neutral mode. With a return path open to the reservoir, pressure in the central bore 100 and in the chamber 96 drop. When the force exerted by the fluid in the chamber 96 on the piston 22 is less than that exerted by the spring 72, the piston 22 will retract, withdrawing the ram 20.

In previously known hydraulic log splitters, extension of the piston was accomplished by directing pressurized fluid to one side of the piston, and retraction of the piston was accomplished by directing pressurized fluid to the other side of the piston. If the piston's travel in either direction were obstructed, the force exerted by the piston would increase as pressure of the hydraulic fluid increased. If the operator were in the area of the ram during retraction, and became entangled with the retracting ram or an engaged log, the high forces exerted could seriously injure the operator.

For the safety of the operator, it is known to utilize a device which senses the pressure developed during ram retraction. The device diverts hydraulic fluid from the ram if a pressure buildup is sensed during retraction, for example by repositioning the control valve to a neutral position. Such a device is not passively safe; it requires a positive action of the device to perform the safety function.

The present invention provides for safer retraction of the hydraulic ram. The log splitter 10 utilizes the spring 72 to retract the piston 22. The use of hydraulic fluid pressures is limited to extension of the piston 22. If the ram 20 should become obstructed during retraction, the force exerted by the spring 72 on the piston 22 and the ram 20 does not increase, thereby providing improved safety for the operator of the log splitter 10. Additionally, no device is required to actuate in order to prevent increased forces from being exerted by the ram 20 during retraction.

Figure 9:
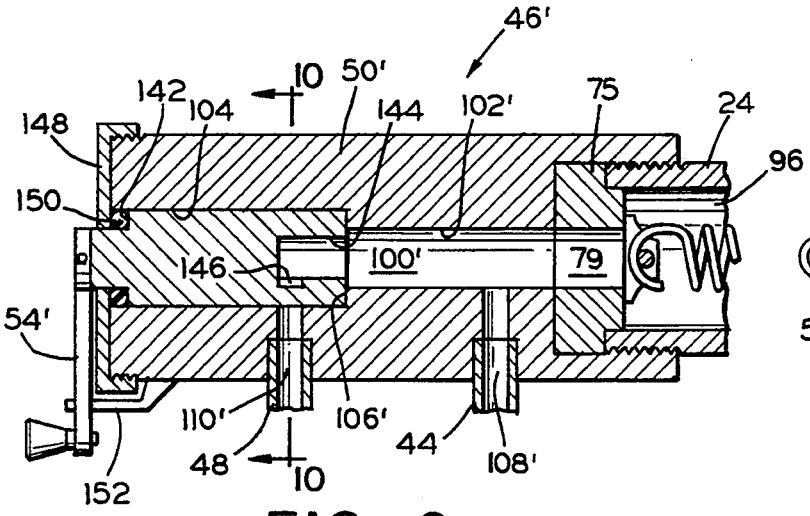
FIG. 9 is a cross sectional side elevational view of an alternate embodiment of a hydraulic control valve utilizing a rotary valve action.
Figure 10:
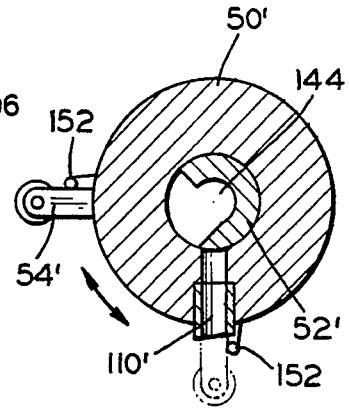
FIG. 10 is a cross sectional view of the rotary valve as seen along the line 10—10 of FIG. 9.

FIGS. 9 and 10 illustrate an alternate embodiment of a control valve 46′ of the present invention. The control valve 46′ is threaded onto the cylinder 24 in a manner similar to the control valve 46 previously described. The control valve 46′ includes a body 50′ and a rotary spool 52′ which may be operated by a handle 54′. As with the control valve 46 discussed above, the control valve 46′ may be operated in an extend mode to direct the flow of fluid from the supply conduit 44 via an inlet 108′ into the cylinder 24. Similarly, the control valve 46′ may be place in a neutral mode in which the flow of fluid out of a fluid outlet 110′ to the return conduit 48 is permitted.

The control valve body 50′ is provided with a central bore 100′ having a first portion 102′, a second portion 104′, which is of greater diameter than the first portion 102′, and a shoulder 106′ defined therebetween. The first portion 102′ is in fluid communication with the chamber 96′ via the openings 77 and 78 through the spring retainer 75. The first portion 102′ is also in fluid communication with the supply conduit 44 via a fluid inlet 108′.

The spool 52′ includes a shoulder 142 adjacent a first end, and a recess 144 formed in the axial face of a second end. A radial slot 146 is formed in a portion of the circumference of the outer surface of the spool 52′. The slot 146 is in fluid communication with the recess 144.

The spool 52′ is rotatable in the second portion 104′, with the second end thereof abutting the shoulder 106′. When the control valve 46′ is placed in a neutral mode, the spool 52′ is rotated to align the slot 146 with a fluid outlet 110′ formed through the valve body 50′. Thus in the neutral mode, the spool 52′ permits communication from the supply conduit 44 to the fluid outlet 110′, which in turn communicates with the return conduit 48.

When the control valve 46′ is placed in an extend mode, the spool 52′ is rotated to a position where the slot 146 is not aligned with the fluid outlet 110′. The spool 52′ thus provides means for selectively permitting and preventing fluid communication between the fluid inlet 108′ and the fluid outlet 110′.

An annular collar 148 is affixed to the free end of the valve body 50′. A bearing 150 is positioned between the collar 148 and the shoulder 142 formed on the spool 52′. The collar 148, through the bearing 150, supports the spool 52′ against the axial force exerted by pressurized fluid in the axial bore 100. The bearing 150 permits the spool 52′ to rotate freely despite the presence of the axial force. A conventional fluid seal (not shown) is provided between the spool 52′ and the valve body 50′ to prevent leakage from the control valve 46′ around the spool 52′.

As seen in FIG. 10, the valve handle 54′ may be restricted to operation through a ninety degree arc by stops 152 on the valve body 50′. The handle 54′ is fixed to the spool 52′ relative to the slot 146. The control valve 46′ is placed in the extend mode by rotating or lifting the handle 54′ to a horizontal position abutting the upper stop 152 as illustrated in FIG. 10. The slot 146 is not aligned with the fluid outlet 110′, and fluid communication between the central bore 100′ and the fluid outlet 110′ is prevented. If the handle 54′ is moved from the horizontal position illustrated, the slot 146 is moved into fluid communication with the fluid outlet 110′, and the valve 46′ is placed in the neutral mode.

If the user releases the handle 54′, gravity will move the handle 54′ downward, rotating it counter-clockwise to the position illustrated in phantom lines in FIG. 10. Thus, the control valve 46′ will change from the extend mode to the neutral mode if the operator does not hold the handle 54′ in the horizontal position. A suitable spring (not shown) may be provided to assist gravity in urging the handle 54′ to rotate the spool 52′ to the neutral position when the handle 54′ is released.

Figure 12:
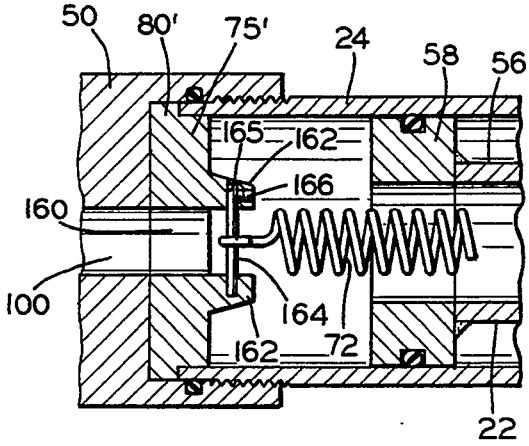
FIG. 12 is a cross sectional view illustrating an alternate embodiment of a spring retainer.

An alternate embodiment of a spring retainer 75′, similar to the first spring retainer 75, is illustrated in FIG. 12. The spring retainer 75′ is generally disk-shaped and is seated within the recess 68. A flange 80′ on the spring retainer 75′ is captured between the control valve body 50 and the axial end of the cylinder 24. A reduced diameter portion of the spring retainer 75′ extends into the cylinder 24 with a slip fit.

The spring retainer 75′ has an axial bore 160 permitting fluid communication between the central bore 100 of the control valve 46 and the interior of the cylinder 24. A pair of lugs 162 located on opposing sides of the bore 160 extend axially from the spring retainer 75′ into the interior of the cylinder 24. A pin 164 extends between the lugs 162 across the bore 160. The pin 164 is retained in a bore 165 formed in the lugs 164 by a set screw 166.

Figure 13:
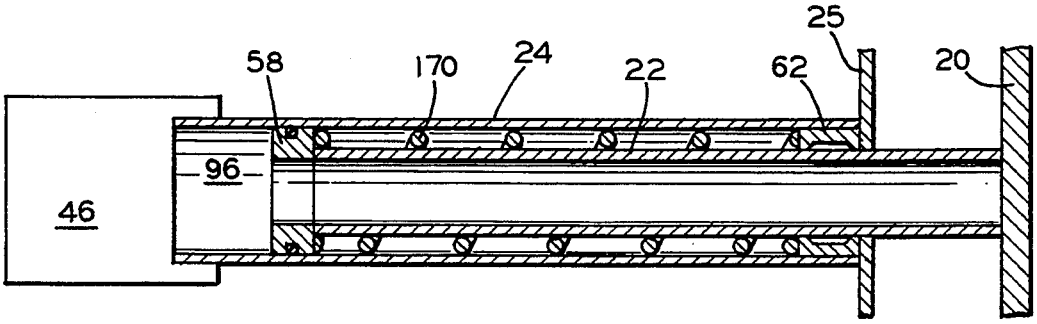
FIG. 13 is a schematic view of an alternate embodiment of the ram return spring.

FIG. 13 illustrates schematically an alternate embodiment for the piston return spring. A helical compression spring 170 is disposed between the piston collar 58 and the bushing 62. The force exerted by pressurized hydraulic fluid in the chamber 96 advances the piston 22 out of a second end of the cylinder 24 adjacent the flange 25. As the piston collar 58 is advanced toward the bushing 62, the spring 170 is compressed. The hydraulic pressure required to advance the piston 22 will increase as the spring 170 is compressed. When the hydraulic fluid in the chamber 96 is vented back to the reservoir through the valve block 46, the compressed spring 170 will urge the piston 22 toward the first end of the cylinder 24. In this embodiment, no spring retainers or spring internal to the piston 22 are needed.

in accordance with the provisions of the patent statutes, together with the principle and mode of operation of the present invention have been explained and illustrated in its preferred embodiment. However, it must be understood that the present invention may be practiced otherwise than as specifically explained and illustrated without departing from its spirit or scope.

What is claimed is:

1. A hydraulic system for a hydraulic log splitter comprising:

a hydraulic circuit having a predetermined maximum design pressure;

an internal combustion engine developing a maximum output torque, said engine stalling when subjected to an output load greater than said maximum output torque; and a pump connected to be driven by said engine, said pump developing a maximum discharge pressure in said hydraulic circuit upon application of said maximum torque to said pump, and wherein said maximum discharge pressure is less than said predetermined maximum design pressure, whereby said engine stalls when said maximum discharge pressure is reached in said hydraulic circuit.

2. In a log splitter including a stationary wedge and a hydraulically operated ram for forcing a log past the wedge, the improvement comprising:

a cylinder including a first end and a second end, a first opening at said first end, and a second opening at said second end;

a piston having a first end slidably received in said cylinder, said piston extend through said second opening to a second end secured to said ram, said piston and said cylinder cooperating to define an expansion chamber;

spring means disposed within said cylinder and adapted to urge said first piston end towards the first cylinder end to move said ram away from said wedge; and means for supplying pressurized fluid into said chamber through said first opening to urge said piston toward the second cylinder end to move said ram towards said wedge.

3. The log splitter of claim 2 and further including a valve having a fluid inlet for receiving a flow of the pressurized fluid, a first passage providing constant fluid communication between said fluid inlet and said first opening, a fluid outlet adapted to divert the flow of pressurized fluid away from said first passage, and means for selectively permitting and preventing fluid communication between said fluid inlet and said fluid outlet.

4. The log splitter of claim 2, wherein said spring means is disposed within said chamber.

5. The log splitter of claim 4, further including a first spring retainer fixed at said first chamber end and a second spring retainer fixed to said second piston end, said spring means including a tension spring having a first end attached to said first spring retainer and having a second end attached to said second spring retainer.

6. The log splitter of claim 2, wherein said spring means is disposed between said piston and said second cylinder end.

7. A linear actuator for operating a tool comprising a hydraulic cylinder including a piston mounted to move between a retracted position and an extended position, said cylinder defining an expansion chamber, spring means for urging said piston to the retracted position, and control means for supplying pressurized fluid to said expansion chamber to move said piston to the extended position and for venting pressurized fluid from said expansion chamber to allow said spring means to move said piston to said retracted position, said control means including a fluid reservoir, fluid pump means for supplying fluid under pressure to said expansion chamber, a fluid return line connecting said expansion chamber to said reservoir, and normally open control valve means for interrupting fluid flow through said fluid return line in response to closure, whereby, when said valve means is closed, fluid pressure builds up in said expansion chamber to move said piston towards the extended position and, when said valve means is open, fluid pressure is vented from said expansion chamber and said spring means moves said piston to the retracted position.

8. A linear actuator for operating a tool comprising a hydraulic cylinder including a piston mounted to move between a retracted position and an extended position, said cylinder defining an expansion chamber, spring means for urging said piston to said retracted position, and control means for supplying pressurized fluid to said expansion chamber to move said piston to the extended position and for venting pressurized fluid from said expansion chamber to allow said spring means to move said piston to said retracted position, said control means including a fluid reservoir, a fluid pump means for supplying fluid under pressure to said expansion chamber, a fluid return line connecting said expansion chamber to said reservoir, and normally open control valve means for interrupting fluid flow through said fluid return line in response to closure, whereby, when said valve means is closed, fluid pressure builds up in said expansion chamber to move said piston towards the extended position and, when said valve means is open, fluid pressure is vented from said expansion chamber and said spring means moves said piston to the retracted position, and wherein said control valve means includes a valve body secured to said hydraulic cylinder, said valve body having a stepped bore having a first end portion connected to said expansion chamber, an enlarged diameter second end portion and a valve seat between said first and second end portions, means for supplying pressurized fluid from said pump means to said first end portion, means connecting said return line to said second end portion, a valve piston mounted to slide in said second end portion towards and away from said seat, spring means urging said valve piston away from said seat to allow fluid to flow from said first end portion to said return line, and means for manually moving said piston to engage said seat and block fluid flow from said first end portion to said return line.

9. A linear actuator, as set forth in claim 8, wherein said means for manually moving said piston comprises a lever, means securing said lever to pivot on said valve body, said lever having a first end adapted to be gripped for manual movement and having a second end adapted to move said valve piston when said lever is pivoted.

10. A linear actuator for operating a tool comprising a hydraulic cylinder including a piston mounted to move between a retracted position and an extended position, said cylinder defining an expansion chamber, spring means for urging said piston to said retracted position, and control means for supplying pressurized fluid to said expansion chamber to move said piston to the extended position and for venting pressurized fluid from said expansion chamber to allow said spring means to move said piston to said retracted position, said control means including a fluid reservoir, a fluid pump means for supplying fluid under pressure to said expansion chamber, a fluid return line connecting said expansion chamber to said reservoir, and normally open control valve means for interrupting fluid flow through said fluid return line in response to closure, whereby, when said valve means is closed, fluid pressure builds up in said expansion chamber to move said piston towards the extended position and, when said valve means is open, fluid pressure is vented from said expansion chamber and said spring means moves said piston to the retracted position, and wherein said spring means for urging said piston to the retracted position includes a tension spring having two ends, means in said expansion chamber securing one of said spring ends to said piston and means in said expansion chamber securing the other of said spring ends to said cylinder.

* * * * *